US008152551B2

(12) United States Patent
Zraik

(10) Patent No.: US 8,152,551 B2
(45) Date of Patent: Apr. 10, 2012

(54) PORT SEIZING CABLE CONNECTOR NUT AND ASSEMBLY

(75) Inventor: Souheil Zraik, Liverpool, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 12/841,754

(22) Filed: Jul. 22, 2010

(65) Prior Publication Data

US 2012/0021642 A1 Jan. 26, 2012

(51) Int. Cl.
*H01R 4/38* (2006.01)

(52) U.S. Cl. ..... 439/322

(58) Field of Classification Search ..... 439/322, 439/321, 578, 585

See application file for complete search history.

(56) References Cited

U.S. PATENT DOCUMENTS

| | | | |
|---|---|---|---|
| 1,667,485 | A | 4/1928 | MacDonald |
| 1,766,869 | A | 6/1930 | Austin |
| 2,258,737 | A | 10/1941 | Browne |
| 2,325,549 | A | 7/1943 | Ryzowitz |
| 2,480,963 | A | 9/1949 | Quinn |
| 2,544,654 | A | 3/1951 | Brown |
| 2,549,647 | A | 4/1951 | Turenne |
| 2,694,187 | A | 11/1954 | Nash |
| 2,754,487 | A | 7/1956 | Carr et al. |
| 2,755,331 | A | 7/1956 | Melcher |
| 2,757,351 | A | 7/1956 | Klostermann |
| 2,762,025 | A | 9/1956 | Melcher |
| 2,805,399 | A | 9/1957 | Leeper |
| 2,870,420 | A | 1/1959 | Malek |
| 3,001,169 | A | 9/1961 | Blonder |
| 3,091,748 | A | 5/1963 | Takes et al. |
| 3,094,364 | A | 6/1963 | Lingg |
| 3,184,706 | A | 5/1965 | Atkins |
| 3,196,382 | A | 7/1965 | Morello, Jr. |
| 3,245,027 | A | 4/1966 | Ziegler, Jr. |
| 3,275,913 | A | 9/1966 | Blanchard et al. |
| 3,278,890 | A | 10/1966 | Cooney |
| 3,281,757 | A | 10/1966 | Bonhomme |
| 3,292,136 | A | 12/1966 | Somerset |
| 3,320,575 | A | 5/1967 | Brown et al. |

(Continued)

FOREIGN PATENT DOCUMENTS

CA 2096710 A1 11/1994

(Continued)

OTHER PUBLICATIONS

Digicon AVL Connector. ARRIS Group Inc. [online]. 3 pages. [retrieved on Apr. 22, 2010]. Retrieved from the Internet:<URL: http://www.arrisi.com/special/digiconAVL.asp>.

*Primary Examiner* — Phuong Dinh
(74) *Attorney, Agent, or Firm* — Schmeiser Olsen & Watts

(57) ABSTRACT

A coaxial cable connector includes a connector body having a first end and a second end, a coupling nut freely rotatable and disposed in relation to the first end of the connector body and a post having a first end and a second end, the post further including a open-ended port retaining portion. The coupling nut includes an internal threaded portion and is disposed in overlaying relation relative to the port retaining portion, which is configured for engaging an external port. The port retaining portion defines a locking collet that prevents loosening of the engaged port, while still guaranteeing electrical continuity without requiring excessive tightening of the connector.

19 Claims, 10 Drawing Sheets

U.S. PATENT DOCUMENTS

| | | | |
|---|---|---|---|
| 3,321,732 | A | 5/1967 | Forney, Jr. |
| 3,336,563 | A | 8/1967 | Hyslop |
| 3,348,186 | A | 10/1967 | Rosen |
| 3,350,677 | A | 10/1967 | Daum |
| 3,355,698 | A | 11/1967 | Keller |
| 3,373,243 | A | 3/1968 | Janowiak et al. |
| 3,390,374 | A | 6/1968 | Forney, Jr. |
| 3,406,373 | A | 10/1968 | Forney, Jr. |
| 3,448,430 | A | 6/1969 | Kelly |
| 3,453,376 | A | 7/1969 | Ziegler, Jr. et al. |
| 3,465,281 | A | 9/1969 | Florer |
| 3,475,545 | A | 10/1969 | Stark et al. |
| 3,498,647 | A | 3/1970 | Schroder |
| 3,517,373 | A | 6/1970 | Jamon |
| 3,533,051 | A | 10/1970 | Ziegler, Jr. |
| 3,537,065 | A | 10/1970 | Winston |
| 3,544,705 | A | 12/1970 | Winston |
| 3,551,882 | A | 12/1970 | O'Keefe |
| 3,564,487 | A | 2/1971 | Upstone et al. |
| 3,587,033 | A | 6/1971 | Brorein et al. |
| 3,601,776 | A | 8/1971 | Curl |
| 3,629,792 | A | 12/1971 | Dorrell |
| 3,633,150 | A | 1/1972 | Swartz |
| 3,646,502 | A | 2/1972 | Hutter et al. |
| 3,663,926 | A | 5/1972 | Brandt |
| 3,665,371 | A | 5/1972 | Cripps |
| 3,668,612 | A | 6/1972 | Nepovim |
| 3,669,472 | A | 6/1972 | Nadsady |
| 3,671,922 | A | 6/1972 | Zerlin et al. |
| 3,678,445 | A | 7/1972 | Brancaleone |
| 3,680,034 | A | 7/1972 | Chow et al. |
| 3,681,739 | A | 8/1972 | Kornick |
| 3,683,320 | A | 8/1972 | Woods et al. |
| 3,686,623 | A | 8/1972 | Nijman |
| 3,694,792 | A | 9/1972 | Wallo |
| 3,706,958 | A | 12/1972 | Blanchenot |
| 3,710,005 | A | 1/1973 | French |
| 3,739,076 | A | 6/1973 | Schwartz |
| 3,744,007 | A | 7/1973 | Horak |
| 3,744,011 | A | 7/1973 | Blanchenot |
| 3,778,535 | A | 12/1973 | Forney, Jr. |
| 3,781,762 | A | 12/1973 | Quackenbush |
| 3,781,898 | A | 12/1973 | Holloway |
| 3,793,610 | A | 2/1974 | Brishka |
| 3,798,589 | A | 3/1974 | Deardurff |
| 3,808,580 | A | 4/1974 | Johnson |
| 3,810,076 | A | 5/1974 | Hutter |
| 3,835,443 | A | 9/1974 | Arnold et al. |
| 3,836,700 | A | 9/1974 | Niemeyer |
| 3,845,453 | A | 10/1974 | Hemmer |
| 3,846,738 | A | 11/1974 | Nepovim |
| 3,854,003 | A | 12/1974 | Duret |
| 3,879,102 | A | 4/1975 | Horak |
| 3,886,301 | A | 5/1975 | Cronin et al. |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |
| 3,953,097 | A | 4/1976 | Graham |
| 3,963,320 | A | 6/1976 | Spinner |
| 3,963,321 | A | 6/1976 | Burger et al. |
| 3,970,355 | A | 7/1976 | Pitschi |
| 3,972,013 | A | 7/1976 | Shapiro |
| 3,976,352 | A | 8/1976 | Spinner |
| 3,980,805 | A | 9/1976 | Lipari |
| 3,985,418 | A | 10/1976 | Spinner |
| 4,030,798 | A | 6/1977 | Paoli |
| 4,046,451 | A | 9/1977 | Juds et al. |
| 4,053,200 | A | 10/1977 | Pugner |
| 4,059,330 | A | 11/1977 | Shirey |
| 4,079,343 | A | 3/1978 | Nijman |
| 4,082,404 | A | 4/1978 | Flatt |
| 4,090,028 | A | 5/1978 | Vontobel |
| 4,093,335 | A | 6/1978 | Schwartz et al. |
| 4,106,839 | A | 8/1978 | Cooper |
| 4,125,308 | A | 11/1978 | Schilling |
| 4,126,372 | A | 11/1978 | Hashimoto et al. |
| 4,131,332 | A | 12/1978 | Hogendobler et al. |
| 4,150,250 | A | 4/1979 | Lundeberg |
| 4,153,320 | A | 5/1979 | Townshend |
| 4,156,554 | A | 5/1979 | Aujla |
| 4,165,911 | A | 8/1979 | Laudig |
| 4,168,921 | A | 9/1979 | Blanchard |
| 4,173,385 | A | 11/1979 | Fenn et al. |
| 4,174,875 | A | 11/1979 | Wilson et al. |
| 4,187,481 | A | 2/1980 | Boutros |
| 4,225,162 | A | 9/1980 | Dola |
| 4,227,765 | A | 10/1980 | Neumann et al. |
| 4,229,714 | A | 10/1980 | Yu |
| 4,250,348 | A | 2/1981 | Kitagawa |
| 4,280,749 | A | 7/1981 | Hemmer |
| 4,285,564 | A | 8/1981 | Spinner |
| 4,290,663 | A | 9/1981 | Fowler et al. |
| 4,296,986 | A | 10/1981 | Herrmann et al. |
| 4,307,926 | A | 12/1981 | Smith |
| 4,322,121 | A | 3/1982 | Riches et al. |
| 4,339,166 | A | 7/1982 | Dayton |
| 4,346,958 | A | 8/1982 | Blanchard |
| 4,354,721 | A | 10/1982 | Luzzi |
| 4,358,174 | A | 11/1982 | Dreyer |
| 4,373,767 | A | 2/1983 | Cairns |
| 4,389,081 | A | 6/1983 | Gallusser et al. |
| 4,400,050 | A | 8/1983 | Hayward |
| 4,407,529 | A | 10/1983 | Holman |
| 4,408,821 | A | 10/1983 | Forney, Jr. |
| 4,408,822 | A | 10/1983 | Nikitas |
| 4,421,377 | A | 12/1983 | Spinner |
| 4,426,127 | A | 1/1984 | Kubota |
| 4,444,453 | A | 4/1984 | Kirby et al. |
| 4,452,503 | A | 6/1984 | Forney, Jr. |
| 4,456,323 | A | 6/1984 | Pitcher et al. |
| 4,462,653 | A | 7/1984 | Flederbach et al. |
| 4,464,000 | A | 8/1984 | Werth et al. |
| 4,469,386 | A | 9/1984 | Ackerman |
| 4,470,657 | A | 9/1984 | Deacon |
| 4,484,792 | A | 11/1984 | Tengler et al. |
| 4,484,796 | A | 11/1984 | Sato et al. |
| 4,506,943 | A | 3/1985 | Drogo |
| 4,515,427 | A | 5/1985 | Smit |
| 4,525,017 | A | 6/1985 | Schildkraut et al. |
| 4,531,805 | A | 7/1985 | Werth |
| 4,533,191 | A | 8/1985 | Blackwood |
| 4,540,231 | A | 9/1985 | Forney, Jr. |
| RE31,995 | E | 10/1985 | Ball |
| 4,545,637 | A | 10/1985 | Bosshard et al. |
| 4,575,274 | A | 3/1986 | Hayward |
| 4,580,862 | A | 4/1986 | Johnson |
| 4,580,865 | A | 4/1986 | Fryberger |
| 4,583,811 | A | 4/1986 | McMills |
| 4,585,289 | A | 4/1986 | Bocher |
| 4,588,246 | A | 5/1986 | Schildkraut et al. |
| 4,593,964 | A | 6/1986 | Forney, Jr. et al. |
| 4,596,434 | A | 6/1986 | Saba et al. |
| 4,596,435 | A | 6/1986 | Bickford |
| 4,598,961 | A | 7/1986 | Cohen |
| 4,600,263 | A | 7/1986 | DeChamp et al. |
| 4,613,199 | A | 9/1986 | McGeary |
| 4,614,390 | A | 9/1986 | Baker |
| 4,616,900 | A | 10/1986 | Cairns |
| 4,632,487 | A | 12/1986 | Wargula |
| 4,634,213 | A | 1/1987 | Larsson et al. |
| 4,640,572 | A | 2/1987 | Conlon |
| 4,645,281 | A | 2/1987 | Burger |
| 4,650,228 | A | 3/1987 | McMills et al. |
| 4,655,159 | A | 4/1987 | McMills |
| 4,655,534 | A | 4/1987 | Stursa |
| 4,660,921 | A | 4/1987 | Hauver |
| 4,668,043 | A | 5/1987 | Saba et al. |
| 4,674,818 | A | 6/1987 | McMills et al. |
| 4,676,577 | A | 6/1987 | Szegda |
| 4,682,832 | A | 7/1987 | Punako et al. |
| 4,684,201 | A | 8/1987 | Hutter |
| 4,688,876 | A | 8/1987 | Morelli |
| 4,688,878 | A | 8/1987 | Cohen et al. |
| 4,691,976 | A | 9/1987 | Cowen |
| 4,703,987 | A | 11/1987 | Gallusser et al. |
| 4,703,988 | A | 11/1987 | Raux et al. |

4,717,355 A 1/1988 Mattis
4,734,050 A 3/1988 Negre et al.
4,734,666 A 3/1988 Ohya et al.
4,737,123 A 4/1988 Paler et al.
4,738,009 A 4/1988 Down et al.
4,746,305 A 5/1988 Nomura
4,747,786 A 5/1988 Hayashi et al.
4,749,821 A 6/1988 Linton et al.
4,755,152 A 7/1988 Elliot et al.
4,757,297 A 7/1988 Frawley
4,759,729 A 7/1988 Kemppainen et al.
4,761,146 A 8/1988 Sohoel
4,772,222 A 9/1988 Laudig et al.
4,789,355 A 12/1988 Lee
4,806,116 A 2/1989 Ackerman
4,807,891 A 2/1989 Neher
4,808,128 A 2/1989 Werth
4,813,886 A 3/1989 Roos et al.
4,820,185 A 4/1989 Moulin
4,834,675 A 5/1989 Samchisen
4,835,342 A 5/1989 Guginsky
4,836,801 A 6/1989 Ramirez
4,838,813 A 6/1989 Pauza et al.
4,854,893 A 8/1989 Morris
4,857,014 A 8/1989 Alf et al.
4,867,706 A 9/1989 Tang
4,869,679 A 9/1989 Szegda
4,874,331 A 10/1989 Iverson
4,892,275 A 1/1990 Szegda
4,902,246 A 2/1990 Samchisen
4,906,207 A 3/1990 Banning et al.
4,915,651 A 4/1990 Bout
4,921,447 A 5/1990 Capp et al.
4,923,412 A 5/1990 Morris
4,925,403 A 5/1990 Zorzy
4,927,385 A 5/1990 Cheng
4,929,188 A 5/1990 Lionetto et al.
4,938,718 A 7/1990 Guendel
4,941,846 A 7/1990 Guimond et al.
4,952,174 A 8/1990 Sucht et al.
4,957,456 A 9/1990 Olson et al.
4,973,265 A 11/1990 Heeren
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,011,422 A 4/1991 Yeh
5,011,432 A 4/1991 Sucht et al.
5,021,010 A 6/1991 Wright
5,024,606 A 6/1991 Ming-Hwa
5,030,126 A 7/1991 Hanlon
5,037,328 A 8/1991 Karlovich
5,046,964 A 9/1991 Welsh et al.
5,052,947 A 10/1991 Brodie et al.
5,055,060 A 10/1991 Down et al.
5,062,804 A 11/1991 Jamet et al.
5,066,248 A 11/1991 Gaver, Jr. et al.
5,073,129 A 12/1991 Szegda
5,080,600 A 1/1992 Baker et al.
5,083,943 A 1/1992 Tarrant
5,120,260 A 6/1992 Jackson
5,127,853 A 7/1992 McMills et al.
5,131,862 A 7/1992 Gershfeld
5,137,470 A 8/1992 Doles
5,137,471 A 8/1992 Verespej et al.
5,141,448 A 8/1992 Mattingly et al.
5,141,451 A 8/1992 Down
5,149,274 A 9/1992 Gallusser et al.
5,154,636 A 10/1992 Vaccaro et al.
5,161,993 A 11/1992 Leibfried, Jr.
5,166,477 A 11/1992 Perin, Jr. et al.
5,181,161 A 1/1993 Hirose et al.
5,183,417 A 2/1993 Bools
5,186,501 A 2/1993 Mano
5,186,655 A 2/1993 Glenday et al.
5,195,905 A 3/1993 Pesci
5,195,906 A 3/1993 Szegda
5,205,547 A 4/1993 Mattingly
5,205,761 A 4/1993 Nilsson
5,207,602 A 5/1993 McMills et al.
5,215,477 A 6/1993 Weber et al.
5,217,391 A 6/1993 Fisher, Jr.
5,217,393 A 6/1993 Del Negro et al.
5,227,587 A 7/1993 Paterek
5,247,424 A 9/1993 Harris et al.
5,269,701 A 12/1993 Leibfried, Jr.
5,283,853 A 2/1994 Szegda
5,284,449 A 2/1994 Vaccaro
5,294,864 A 3/1994 Do
5,295,864 A 3/1994 Birch et al.
5,316,494 A 5/1994 Flanagan et al.
5,318,459 A 6/1994 Shields
5,334,032 A 8/1994 Myers et al.
5,334,051 A 8/1994 Devine et al.
5,338,225 A 8/1994 Jacobsen et al.
5,342,218 A 8/1994 McMills et al.
5,354,217 A 10/1994 Gabel et al.
5,362,250 A 11/1994 McMills et al.
5,371,819 A 12/1994 Szegda
5,371,821 A 12/1994 Szegda
5,371,827 A 12/1994 Szegda
5,380,211 A 1/1995 Kawaguchi et al.
5,389,005 A 2/1995 Kodama
5,393,244 A 2/1995 Szegda
5,413,504 A 5/1995 Kloecker et al.
5,431,583 A 7/1995 Szegda
5,435,745 A 7/1995 Booth
5,439,386 A 8/1995 Ellis et al.
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,257 A 11/1995 Szegda
5,474,478 A 12/1995 Ballog
5,490,801 A 2/1996 Fisher, Jr. et al.
5,494,454 A 2/1996 Johnsen
5,499,934 A 3/1996 Jacobsen et al.
5,501,616 A 3/1996 Holliday
5,516,303 A 5/1996 Yohn et al.
5,525,076 A 6/1996 Down
5,542,861 A 8/1996 Anhalt et al.
5,548,088 A 8/1996 Gray et al.
5,550,521 A 8/1996 Bernaud et al.
5,564,938 A 10/1996 Shenkal et al.
5,571,028 A 11/1996 Szegda
5,586,910 A 12/1996 Del Negro et al.
5,595,499 A 1/1997 Zander et al.
5,598,132 A 1/1997 Stabile
5,607,325 A 3/1997 Toma
5,620,339 A 4/1997 Gray et al.
5,632,637 A 5/1997 Diener
5,632,651 A 5/1997 Szegda
5,644,104 A 7/1997 Porter et al.
5,651,698 A 7/1997 Locati et al.
5,651,699 A 7/1997 Holliday
5,653,605 A 8/1997 Woehl et al.
5,667,405 A 9/1997 Holliday
5,683,263 A 11/1997 Hsu
5,702,263 A 12/1997 Baumann et al.
5,722,856 A 3/1998 Fuchs et al.
5,735,704 A 4/1998 Anthony
5,746,617 A 5/1998 Porter, Jr. et al.
5,746,619 A 5/1998 Harting et al.
5,769,652 A 6/1998 Wider
5,775,927 A 7/1998 Wider
5,863,220 A 1/1999 Holliday
5,877,452 A 3/1999 McConnell
5,879,191 A 3/1999 Burris
5,882,226 A 3/1999 Bell et al.
5,921,793 A 7/1999 Phillips
5,938,465 A 8/1999 Fox, Sr.
5,944,548 A 8/1999 Saito
5,957,716 A 9/1999 Buckley et al.
5,967,852 A 10/1999 Follingstad et al.

| | | | |
|---|---|---|---|
| 5,975,949 | A | 11/1999 | Holliday et al. |
| 5,975,951 | A | 11/1999 | Burris et al. |
| 5,977,841 | A | 11/1999 | Lee et al. |
| 5,997,350 | A | 12/1999 | Burris et al. |
| 6,010,349 | A | 1/2000 | Porter, Jr. |
| 6,019,635 | A | 2/2000 | Nelson |
| 6,022,237 | A | 2/2000 | Esh |
| 6,032,358 | A | 3/2000 | Wild |
| 6,042,422 | A | 3/2000 | Youtsey |
| 6,048,229 | A | 4/2000 | Lazaro, Jr. |
| 6,053,777 | A | 4/2000 | Boyle |
| 6,089,903 | A | 7/2000 | Stafford Gray et al. |
| 6,089,912 | A | 7/2000 | Tallis et al. |
| 6,089,913 | A | 7/2000 | Holliday |
| 6,123,567 | A | 9/2000 | McCarthy |
| 6,146,197 | A | 11/2000 | Holliday et al. |
| 6,152,753 | A | 11/2000 | Johnson et al. |
| 6,153,830 | A | 11/2000 | Montena |
| 6,210,222 | B1 | 4/2001 | Langham et al. |
| 6,217,383 | B1 | 4/2001 | Holland et al. |
| 6,239,359 | B1 | 5/2001 | Lilienthal, II et al. |
| 6,241,553 | B1 | 6/2001 | Hsia |
| 6,261,126 | B1 | 7/2001 | Stirling |
| 6,271,464 | B1 | 8/2001 | Cunningham |
| 6,331,123 | B1 | 12/2001 | Rodrigues |
| 6,332,815 | B1 | 12/2001 | Bruce |
| 6,358,077 | B1 | 3/2002 | Young |
| D458,904 | S | 6/2002 | Montena |
| 6,406,330 | B2 | 6/2002 | Bruce |
| D460,739 | S | 7/2002 | Fox |
| D460,740 | S | 7/2002 | Montena |
| D460,946 | S | 7/2002 | Montena |
| D460,947 | S | 7/2002 | Montena |
| D460,948 | S | 7/2002 | Montena |
| 6,422,900 | B1 | 7/2002 | Hogan |
| 6,425,782 | B1 | 7/2002 | Holland |
| D461,166 | S | 8/2002 | Montena |
| D461,167 | S | 8/2002 | Montena |
| D461,778 | S | 8/2002 | Fox |
| D462,058 | S | 8/2002 | Montena |
| D462,060 | S | 8/2002 | Fox |
| D462,327 | S | 9/2002 | Montena |
| 6,468,100 | B1 | 10/2002 | Meyer et al. |
| 6,491,546 | B1 | 12/2002 | Perry |
| D468,696 | S | 1/2003 | Montena |
| 6,506,083 | B1 | 1/2003 | Bickford et al. |
| 6,530,807 | B2 | 3/2003 | Rodrigues et al. |
| 6,540,531 | B2 | 4/2003 | Syed et al. |
| 6,558,194 | B2 | 5/2003 | Montena |
| 6,572,419 | B2 | 6/2003 | Feye-Homann |
| 6,576,833 | B2 | 6/2003 | Covaro et al. |
| 6,619,876 | B2 | 9/2003 | Vaitkus et al. |
| 6,676,446 | B2 | 1/2004 | Montena |
| 6,683,253 | B1 | 1/2004 | Lee |
| 6,692,285 | B2 | 2/2004 | Islam |
| 6,712,631 | B1 | 3/2004 | Youtsey |
| 6,716,062 | B1 | 4/2004 | Palinkas et al. |
| 6,733,336 | B1 | 5/2004 | Montena et al. |
| 6,733,337 | B2 | 5/2004 | Kodaira |
| 6,767,248 | B1 | 7/2004 | Hung |
| 6,786,767 | B1 | 9/2004 | Fuks et al. |
| 6,790,081 | B2 | 9/2004 | Burris et al. |
| 6,805,584 | B1 | 10/2004 | Chen |
| 6,817,896 | B2 | 11/2004 | Derenthal |
| 6,848,939 | B2 | 2/2005 | Stirling |
| 6,848,940 | B2 | 2/2005 | Montena |
| 6,884,113 | B1 | 4/2005 | Montena |
| 6,884,115 | B2 | 4/2005 | Malloy |
| 6,929,508 | B1 | 8/2005 | Holland |
| 6,939,169 | B2 | 9/2005 | Islam et al. |
| 6,971,912 | B2 | 12/2005 | Montena et al. |
| 7,029,326 | B2 | 4/2006 | Montena |
| 7,070,447 | B1 | 7/2006 | Montena |
| 7,086,897 | B2 | 8/2006 | Montena |
| 7,097,499 | B1 * | 8/2006 | Purdy ..... 439/578 |
| 7,102,868 | B2 | 9/2006 | Montena |
| 7,114,990 | B2 | 10/2006 | Bence et al. |
| 7,118,416 | B2 | 10/2006 | Montena et al. |
| 7,125,283 | B1 | 10/2006 | Lin |
| 7,131,868 | B2 | 11/2006 | Montena |
| 7,147,509 | B1 | 12/2006 | Burris et al. |
| 7,156,696 | B1 | 1/2007 | Montena |
| 7,161,785 | B2 | 1/2007 | Chawgo |
| 7,229,303 | B2 | 6/2007 | Vermoesen et al. |
| 7,252,546 | B1 | 8/2007 | Holland |
| 7,255,598 | B2 | 8/2007 | Montena et al. |
| 7,299,550 | B2 | 11/2007 | Montena |
| 7,393,245 | B2 | 7/2008 | Palinkas et al. |
| 7,452,239 | B2 | 11/2008 | Montena |
| 7,476,127 | B1 | 1/2009 | Wei |
| 7,479,035 | B2 | 1/2009 | Bence et al. |
| 7,497,729 | B1 | 3/2009 | Wei |
| 7,507,117 | B2 | 3/2009 | Amidon |
| 7,544,094 | B1 | 6/2009 | Paglia et al. |
| 7,566,236 | B2 | 7/2009 | Malloy et al. |
| 7,607,942 | B1 | 10/2009 | Van Swearingen |
| 7,674,132 | B1 | 3/2010 | Chen |
| 7,682,177 | B2 | 3/2010 | Berthet |
| 7,727,011 | B2 | 6/2010 | Montena et al. |
| 7,753,705 | B2 | 7/2010 | Montena |
| 7,794,275 | B2 | 9/2010 | Rodrigues |
| 7,806,725 | B1 | 10/2010 | Chen |
| 7,811,133 | B2 | 10/2010 | Gray |
| 7,824,216 | B2 | 11/2010 | Purdy |
| 7,828,595 | B2 | 11/2010 | Mathews |
| 7,833,053 | B2 | 11/2010 | Mathews |
| 7,845,976 | B2 | 12/2010 | Mathews |
| 7,845,978 | B1 | 12/2010 | Chen |
| 7,850,487 | B1 | 12/2010 | Wei |
| 7,857,661 | B1 | 12/2010 | Islam |
| 7,892,005 | B2 | 2/2011 | Haube |
| 7,892,024 | B1 | 2/2011 | Chen |
| 7,927,135 | B1 | 4/2011 | Wlos |
| 7,950,958 | B2 | 5/2011 | Mathews |
| 2002/0013088 | A1 | 1/2002 | Rodrigues et al. |
| 2002/0038720 | A1 | 4/2002 | Kai et al. |
| 2003/0214370 | A1 | 11/2003 | Allison et al. |
| 2004/0077215 | A1 | 4/2004 | Palinkas et al. |
| 2004/0102089 | A1 | 5/2004 | Chee |
| 2004/0209516 | A1 | 10/2004 | Burris et al. |
| 2004/0219833 | A1 | 11/2004 | Burris et al. |
| 2004/0229504 | A1 | 11/2004 | Liu |
| 2005/0042919 | A1 | 2/2005 | Montena |
| 2005/0208827 | A1 | 9/2005 | Burris et al. |
| 2006/0110977 | A1 | 5/2006 | Mathews |
| 2006/0154519 | A1 | 7/2006 | Montena |
| 2007/0026734 | A1 | 2/2007 | Bence et al. |
| 2008/0102696 | A1 | 5/2008 | Montena |
| 2009/0029590 | A1 | 1/2009 | Sykes et al. |
| 2009/0098770 | A1 | 4/2009 | Bence et al. |
| 2010/0081321 | A1 | 4/2010 | Malloy et al. |
| 2010/0081322 | A1 | 4/2010 | Malloy et al. |
| 2010/0105246 | A1 | 4/2010 | Burris et al. |
| 2010/0255721 | A1 | 10/2010 | Purdy et al. |
| 2010/0279548 | A1 | 11/2010 | Montena et al. |
| 2010/0297871 | A1 | 11/2010 | Haube |
| 2010/0297875 | A1 | 11/2010 | Purdy |
| 2011/0021072 | A1 | 1/2011 | Purdy |
| 2011/0053413 | A1 | 3/2011 | Mathews |
| 2011/0117774 | A1 | 5/2011 | Malloy et al. |
| 2011/0143567 | A1 | 6/2011 | Purdy et al. |
| 2011/0230089 | A1 | 9/2011 | Amidon et al. |
| 2011/0230091 | A1 | 9/2011 | Krenceski et al. |

FOREIGN PATENT DOCUMENTS

| | | | |
|---|---|---|---|
| CN | 201149936 | Y | 11/2008 |
| CN | 201149937 | Y | 11/2008 |
| CN | 201178228 | Y | 1/2009 |
| DE | 47931 | C | 10/1888 |
| DE | 102289 | C | 4/1899 |
| DE | 1117687 | B | 11/1961 |
| DE | 1191880 | | 4/1965 |
| DE | 1515398 | B1 | 4/1970 |
| DE | 2225764 | A1 | 12/1972 |
| DE | 2221936 | A1 | 11/1973 |
| DE | 2261973 | A1 | 6/1974 |
| DE | 3211008 | A1 | 10/1983 |
| DE | 9001608.4 | U1 | 4/1990 |

| | | | |
|---|---|---|---|
| EP | 116157 | A1 | 8/1984 |
| EP | 167738 | A2 | 1/1986 |
| EP | 0072104 | A1 | 2/1986 |
| EP | 0265276 | A2 | 4/1988 |
| EP | 0427424 | A2 | 5/1991 |
| EP | 1191268 | A1 | 3/2002 |
| EP | 1501159 | A1 | 1/2005 |
| EP | 1701410 | A2 | 9/2006 |
| FR | 2232846 | A1 | 1/1975 |
| FR | 2234680 | A2 | 1/1975 |
| FR | 2312918 | | 12/1976 |
| FR | 2462798 | A1 | 2/1981 |
| FR | 2494508 | A1 | 5/1982 |
| GB | 589697 | A | 6/1947 |
| GB | 1087228 | A | 10/1967 |
| GB | 1270846 | A | 4/1972 |
| GB | 1401373 | A | 7/1975 |
| GB | 2019665 | A | 10/1979 |
| GB | 2079549 | A | 1/1982 |
| GB | 2252677 | A | 8/1992 |
| GB | 2264201 | A | 8/1993 |
| GB | 2331634 | A | 5/1999 |
| JP | 3280369 | B2 | 5/2002 |
| KR | 2006100622526 | B1 | 9/2006 |
| TW | 427044 | B | 3/2001 |
| WO | 8700351 | | 1/1987 |
| WO | 0186756 | A1 | 11/2001 |
| WO | 2004013883 | A2 | 2/2004 |
| WO | 2006081141 | A1 | 8/2006 |

* cited by examiner

PORT SEIZING CABLE CONNECTOR NUT AND ASSEMBLY

FIELD OF THE INVENTION

The present application relates generally to the field of coaxial cable connectors for use in broadband and cable communications and other applications and more specifically to a coaxial cable connector having interconnection features enabling more reliable securement to an external interface port.

BACKGROUND OF THE INVENTION

Coaxial cable connectors are replete in the field of broadband communications, among other fields and related applications. A typical coaxial cable connector such as, for example, an F-type connector, retains a prepared coaxial cable end within a connector body that also retains a hollow tubular post. The connector further includes a freely rotatable threaded coupling nut that is secured to the connector body and/or the post. The coupling nut permits attachment between the connector and an appliance such as a television, computer or other device having an external interface port. The prepared coaxial cable end is engaged within the connector body by the post and retained therein wherein the center conductor of the prepared coaxial cable outwardly extends from the mating end of the connector. An external interface port of the appliance having a center receptacle can then be coupled to the center conductor of the coaxial cable wherein the connector is engaged to the port by the coupling nut. Reliable securement of the external interface port to the connector nut using a threaded connection enables both electrical and mechanical interconnection to be made with the connector.

A general problem in the attachment of coaxial cable connectors, such as those noted above, to a external appliance port is that the rotatable coupling nut can loosen over time due to several factors. Among these factors are a lack of adequate initial tightening (e.g., improper number of turns), intended or unintentional movement of the appliance, and/or other reasons. Correction of this problem is a recurrent need in this industry.

Another related concern in the field is that improper tightening of an engaged external interface port invariably results in a lack of electrical continuity. That is, typical coaxial cable connectors require intimate compressive contact between the respective face surfaces of the interface port and a post flange of the connector in order to guarantee effective electrical continuity and to provide adequate shielding from noise and other forms of electrical interference. There is a need, therefore, to provide a coaxial cable connector that addresses, at a minimum, each of the above-noted concerns.

SUMMARY OF THE INVENTION

Therefore and according to one aspect, there is provided a coaxial cable connector comprising a connector body, a coupling nut and a hollow post. The coupling nut includes an internal threaded portion configured for engaging a threaded surface of an external port. The post includes respective opposing first and second ends in which one end is secured within the connector body and the opposing end includes an open-ended port retaining portion. The coupling nut is disposed in overlaying relation onto the open-ended port retaining portion wherein the port is drawn into the open-ended port retaining portion by means of threaded engagement between the coupling nut and the port.

Preferably, the open-ended port retaining portion is a socket having a peripheral wall and a cylindrical receiving cavity, the socket being made from an electrically conductive material, such as brass or steel, wherein electrical continuity is continually provided when the external port is initially received by the connector. Compressive securement is therefore not essential between the radial end face port and the post flange of the connector in order to provide a suitable electrical connection.

In one version, the peripheral wall of the socket includes a plurality of axially disposed slots, defining a plurality of spring fingers and further defining a locking collet.

One of the coupling nut and the open-ended port retaining portion can include an annular ring-like section sized for fitting within a groove formed in the other of the open-ended retaining portion and the coupling nut so as to prevent axial movement, but while still permitting free rotation of the coupling nut.

The herein described coaxial cable connector can be an F-type, or other type of coaxial cable connector that includes a fastening member, such as a compression sleeve, for securing and maintaining a prepared coaxial cable end to the connector body, such as RCA and BNC-type connectors.

According to another aspect, there is described a coaxial cable connector comprising a connector body having a first end, a second end and a center passageway therethrough, a post having a first end fitted within said connector body for engaging a coaxial cable end and a second end having an open-ended port retaining portion. A coupling nut is disposed in overlaying fashion onto the second end of the post, the coupling nut being axially secured to the exterior of the retaining portion but freely rotatable about a primary axis of the connector. The nut includes an interior threaded portion configured for engaging an exterior threaded surface of an external port wherein the port retaining portion defines a locking collet into which the port is drawn by initial securing by threaded engagement between the coupling nut and external port.

According to yet another aspect, there is provided a method of manufacturing a coaxial cable connector, said method comprising the steps of providing a connector body, providing a post having a first end and a second end, disposing the first end of said post within said connector body, axially securing said post relative to said connector body, said second end of said post including an open-ended retaining portion, axially attaching a coupling nut in overlaying relation onto said open-ended retaining portion but permitting said coupling nut to be freely rotatable about said retaining portion, said coupling nut including a threaded portion distally adjacent said open-ended retaining portion, said retaining portion defining a locking collet for securing an interface port.

One advantage provided by the herein described coaxial cable connector is that more reliable and stable securement is created with regard to an external interface or equipment port. That is, advancement of the coupling nut of the herein described connector onto the external port draws the collet onto the port and upon bottoming causes the collet to seize on the port, with a minimum of effort.

Another advantage is that electrical continuity is assured in initial contact between the external port and the open-ended port retaining portion of the cable connector. It is therefore not required that the herein described connector be fully tightened to the port to insure that continuity has been made.

Yet another advantage provided is that the above coaxial cable connector is relatively simple in terms of its use as well as in the manufacture thereof. As a result, the connector also provides cost as well as time savings for manufacturers and installers as well as users.

Yet still another advantage provided is that the torque that is required in order to achieve a substantial and secure lock on an external interface port is relatively minimal wherein contact is made by the collet or spring "fingers" even before lock is achieved, meaning that the coaxial cable connector is still capable of providing adequate shielding contact, even if the connector is improperly used.

These and other features and advantages will become readily apparent from the following Detailed Description, which should be read in conjunction with the accompanying drawings.

DETAILED DESCRIPTION

The following description relates to a coaxial cable connector and more specifically describes an exemplary embodiment featuring a coaxial cable connector. The connector includes features that permit reliable and secure engagement relative to an external equipment or appliance port, as well as provide consistent electrical continuity when so attached. It will be readily understood, however, that other forms of coaxial cable connectors such as, for example, compression-type connectors such as F-type, RCA and BNC-type connectors and/or other suitable types of coaxial cable connectors that can threadingly engage an external port can also be utilized. In addition, several terms are used throughout the course of this description in order to provide a suitable frame of reference with regard to the accompanying drawings. These terms including but not limited to "above", "below", "external", "internal", "first", "second" and the like are not intended to be overlimiting, however, in terms of their intended scope of the claims of this application, except in instances where so specifically indicated.

Figure 1:
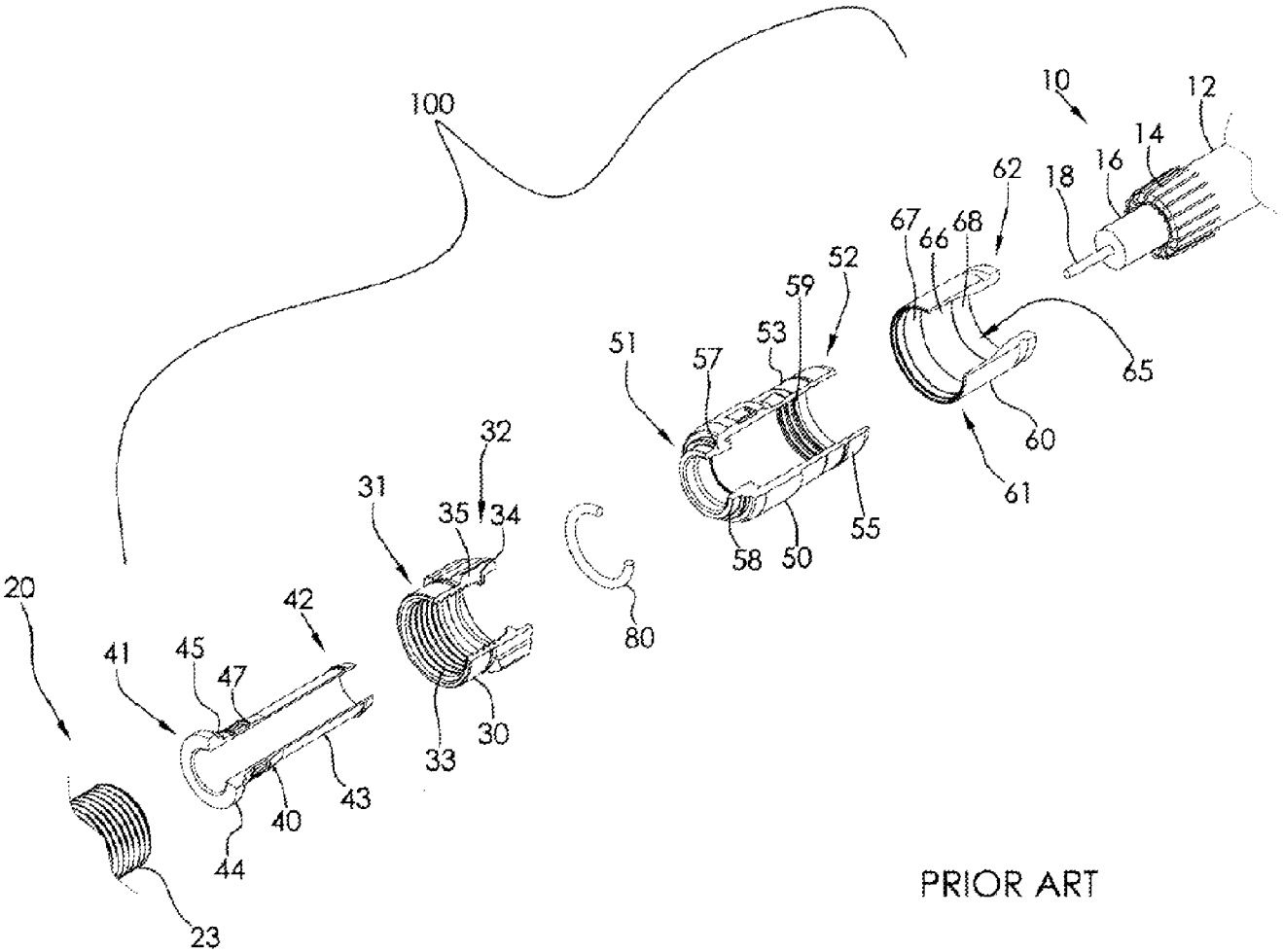
PRIOR ART FIG. 1
FIG. 1 is an exploded perspective view of a coaxial cable connector that is made in accordance with the prior art.

For purposes of providing a suitable initial background and prior to describing the exemplary embodiment, a known prior art coaxial cable connector is shown in FIG. 1 in exploded form. This connector, hereinafter labeled with reference numeral 100, is defined by an assemblage having a number of discrete components that can be operably affixed to the end of a coaxial cable 10, the cable having a protective outer jacket or sleeve 12, a conductive grounding shield 14, an interior or intermediate dielectric layer 16 and a center conductor 18. The end of the coaxial cable 10 can be drawn back, as represented in FIG. 1, by removing an axial portion of the protective outer jacket 12 and then drawing back the conductive grounding shield 14, which may be braided, in order to expose an axial portion of the intermediate dielectric layer 16. Additional preparation of the coaxial cable 10 can include stripping or coring the intermediate dielectric layer 16 in order to expose an axial portion of the center conductor 18. As noted above, the known connector 100 is an assemblage of certain components. These components, include a threaded nut 30, a post 40, a connector body 50, a compression member or sleeve 60 and a connector body sealing member 80, such as an O-ring.

Figure 2:
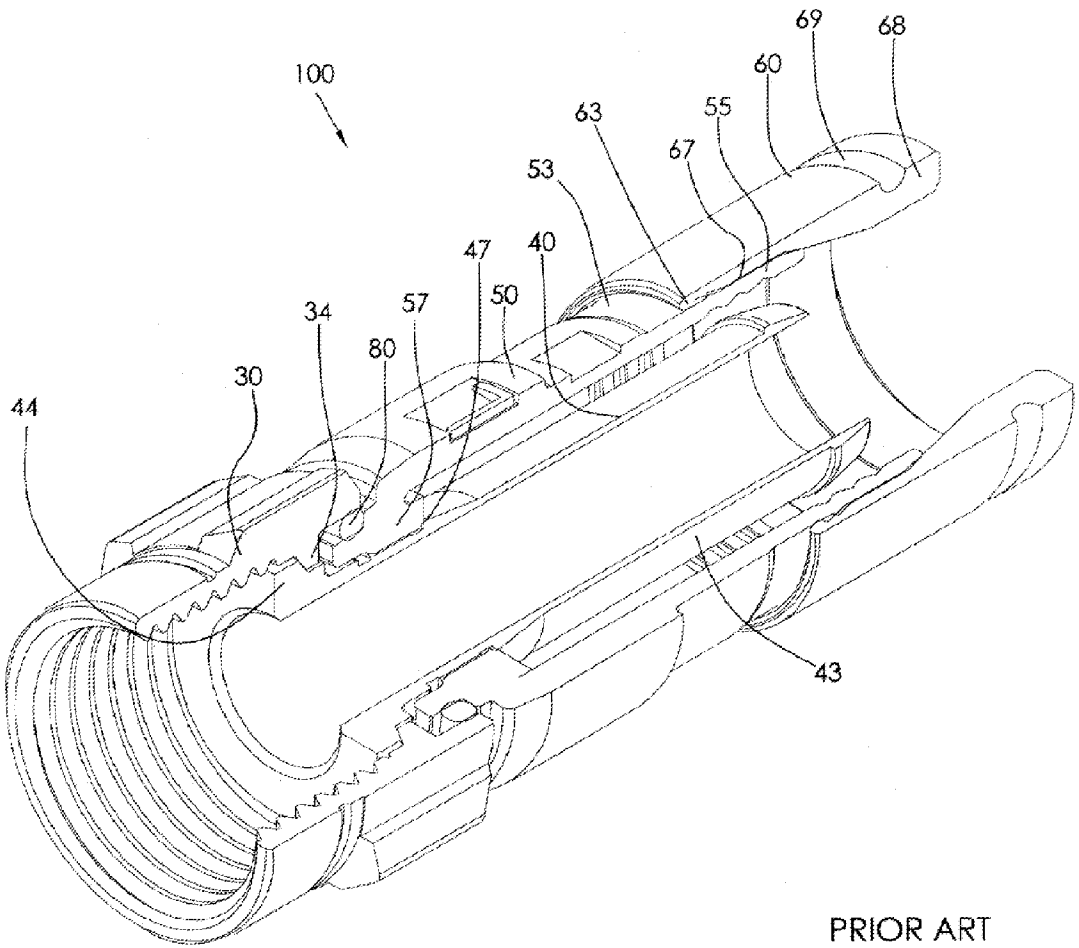
PRIOR ART FIG. 2
FIG. 2 is the perspective view of the prior art coaxial cable connector of FIG. 1, in an assembled form prior to securement of a coaxial cable end.

Each of the components of the connector of FIGS. 1 and 2 are now briefly described, as follows: First, the threaded nut 30 according to this version is formed from an electrically conductive material, the nut having a first end 31 and an opposing second end 32. A set of internal threads 33 extend from the edge of the first end 31 over a sufficient axial distance that permits effective threaded contact with the external threads 23 of a standard coaxial cable interface port 20 (shown partially in FIG. 1). The nut 30 further includes an internal lip 34, in this instance an annular protrusion, which is disposed proximate the second end 32, therein defining a flange.

The post 40 is a rigidly formed body made according to this version from an electrically conductive material and defined by a first end 41 and an opposing second end 42. A flange 44, such as an externally extending annular protrusion, is located at the first end 41 of the post 40 and defined by an annular shoulder 45. The post 40 further includes a hollow shaft portion 43 having a substantially constant and cylindrical cross section extending from the second end 42 to a tapering portion having at least one exterior surface feature 47 intermediately disposed in relation to the first end 41. When assembled, portions of the prepared coaxial cable end 10, including the intermediate dielectric layer 16 and the center conductor 18, are permitted to pass into the second end 42 of the post 40 through the shaft portion 43 while the outer sleeve 12 and shielding layer 14 are caused to be stripped by the second end of the post, as described briefly below.

The connector body 50 includes a first end 51 and an opposing second end 52 that is substantially hollow and defined by an center passageway or bore. Adjacent the first end 51 of the connector body 50 is a post mounting portion 57 that is configured to mate with the at least one exterior surface feature 47 of the post 40, enabling the post to be axially as well as radially secured to the connector body. In addition, the connector body 50 includes an outer annular recess 58 located proximate the first end 51 that is used to retain the sealing member 80, which is an O-ring. A portion 53 of the connector body 50 is formed from a semi-rigid, yet compliant outer surface 55, this portion being configured to form an annular seal when the second end 52 is deformably compressed against a retained coaxial cable 10 by operation of the compression member 60, as described in greater detail below.

The compression member 60 according to this known connector version is defined by a cylindrical sleeve-like section that further includes opposing first and second ends 61, 62, respectively. The first and second ends 61, 62 are interconnected by a center passageway 65, the passageway having a plurality of sections including a first diametrical section 67 adjacent the first end 61 having a first inner diameter and a second diametrical section 68 adjacent the second end having a second inner diameter that is smaller than the first inner diameter. A transitional section 66, provided intermediate the first and second diametrical sections 67, 68, is defined by an interior ramped surface.

The herein described coaxial cable connector 100, still referring to FIGS. 1 and 2, serves to securably retain a prepared coaxial cable end 10. The cable is not shown in FIG. 2 for the sake of clarity. In this configuration, the prepared coaxial cable end 10, including the extending axial section of the center conductor 18, is inserted into the interior of the connector body 50 through the second end 52 thereof as well as through the center passageway 65 of the compression member 60. The second end 42 of the post 40, fitted and secured into the confines of the connector body 50, engages the coaxial cable end 10 between the cored dielectric layer 16 and the grounding shield layer 14. According to this version, the compression member 60 is then axially advanced over the exterior of the connector body 50 by means of a compression tool (not shown) or otherwise, causing the interior ramped surface 66 of the compression member 60 to engage and thereby compress the deformable outer portion 53 of the connector body 50 in a radial fashion inwardly and securing the coaxial cable end 10 within the connector 100. The dielectric layer 16 and center conductor 18 are advanced into the shaft portion 43 of the post 40, while the outer jacket 12 and the shielding layer 14 of the advanced coaxial cable end 10 are additionally stripped by the second end 42 of the post and the action of the compression tool and advancing compression member 60, which passes axially over the connector body 50.

In the meantime, the coupling nut 30 of the herein described coaxial connector 100 is secured to the first end 41 of the post 40 and is mounted so as to permit free rotation, while the center conductor 18 extends through the post flange 44 and outwardly from the coupling nut. More specifically and according to this prior art version, the coupling nut 30 is permitted limited axial movement through rotation thereof, wherein the nut flange 34 is caused to engage directly with the annular flange 44 of the post 40 providing a mechanical stop as the nut is engaged with an external interface port 20.

External threads 23 of the external interface port 20 are then threadingly engaged with the internal threads 33 of the coupling nut 30 of the herein described connector 100, causing the coupling nut 30 to be secured thereupon through limited axial movement of the threaded nut as the lip 34 of the nut engages the flange 44 of the post 40. Electrical continuity is initiated based upon compressive contact that is created between the annular flange 44 of the post 40 and an end radial face of the interface port 20 when the coupling nut 30 has been fully tightened. As noted and though effective, the above coaxial cable connector 10 relies upon specific tolerance matchups between the external interface port 20 and the coupling nut 30 of the coaxial cable connector 100 in order to properly provide an effective connection therebetween. There is no permissible variability for this herein described coaxial cable connector 100, however, to accommodate various sized external interface ports.

Figure 3:
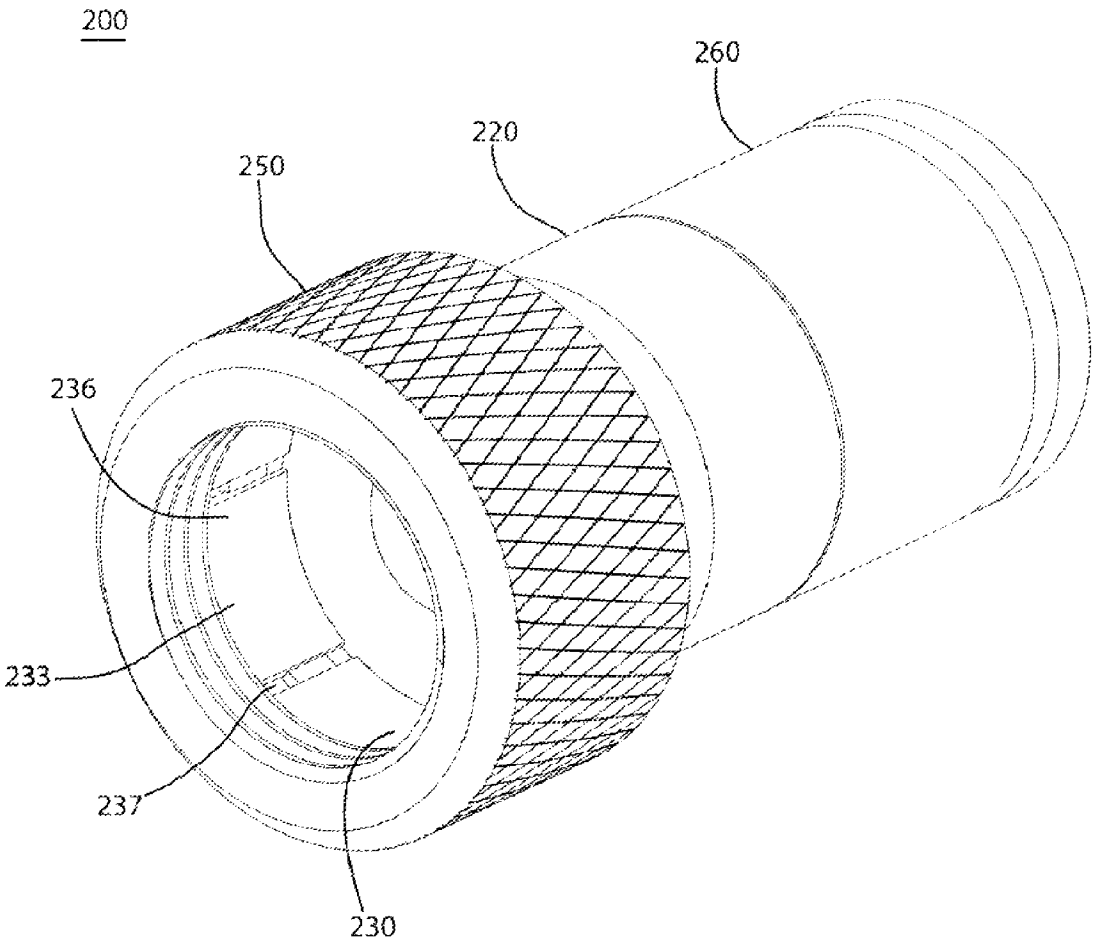
FIG. 3 is a perspective view of a coaxial cable connector that is made in accordance with an exemplary embodiment of the present invention.
Figure 4:
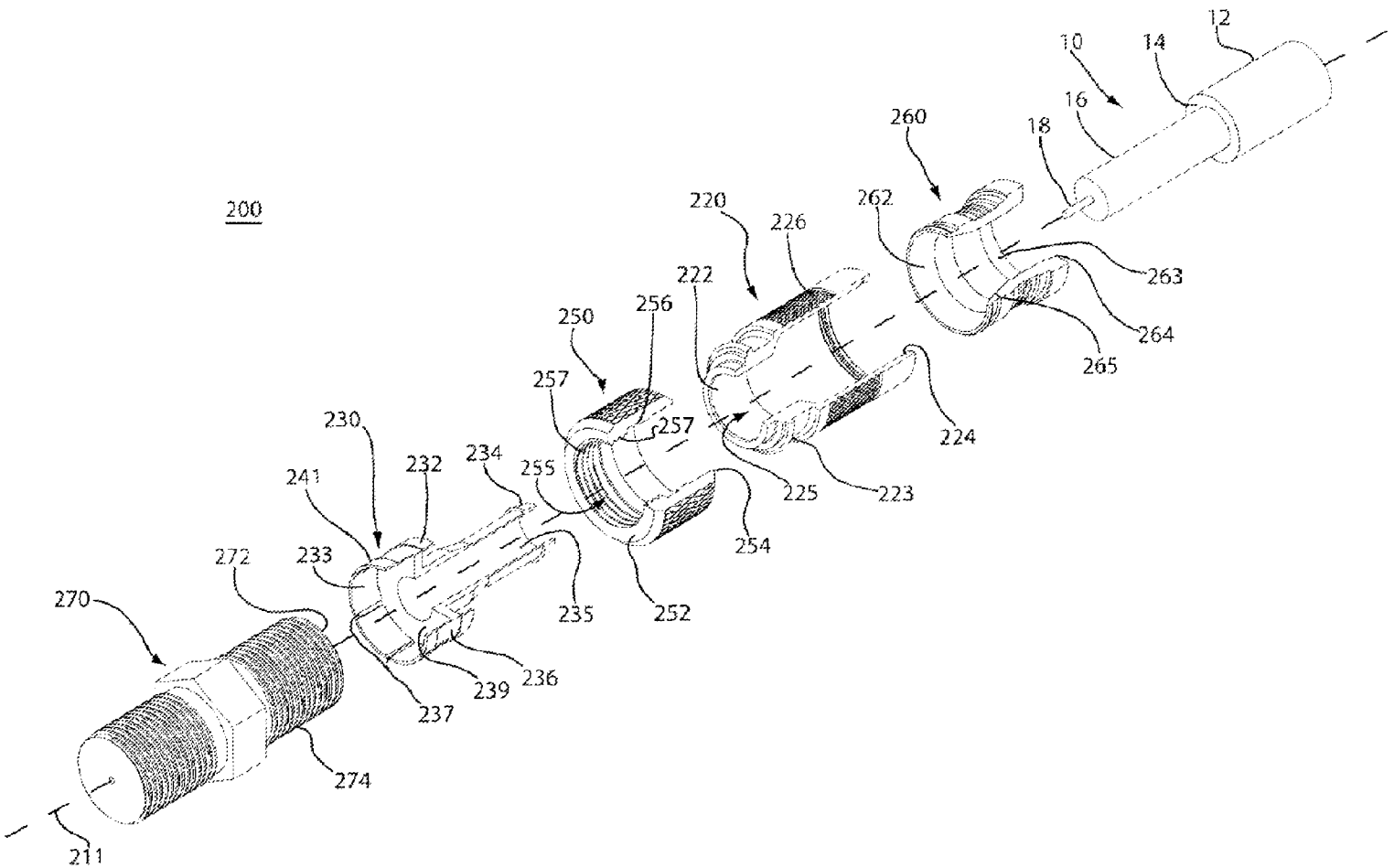
FIG. 4 is an exploded assembly view, shown partially broken away, of the coaxial cable connector of FIG. 3.

With the preceding background and referring to FIGS. 3-10, a coaxial cable connector made in accordance with an exemplary embodiment is herein described. Referring first to FIGS. 3 and 4, the coaxial cable connector, hereinafter referred to by reference numeral 200, is an assemblage that is defined by a plurality of components. This assemblage, according to this exemplary embodiment, can include a connector body 220, a hollow post 230, a coupling nut 250, and a compression member 260.

According to this embodiment, the connector body 220 is defined by a substantially cylindrical member having a first end 222, an opposing second end 224 and a central bore or passageway 225 extending therethrough. The central bore 225 is herein defined by two different interior diameters; namely, a first interior diameter adjacent the first end 222 and a second larger interior diameter adjacent the second end 224. A post securing portion 223 is provided adjacent the first end 222. The connector body 220 according to the herein described embodiment is made from a durable plastic, although it will be readily apparent that other suitable materials can be used, including for example, brass or steel. An axial proximal portion 226 of the connector body 220 adjacent the second end 224 is deformable upon the application of sufficient radial force thereupon.

The post 230 according to this embodiment is a substantially hollow tubular member having opposing first and second ends 232, 234. The post 230 is sized such that the second end 234 can fit within the confines of the central passageway 225 of the connector body 220 when inserted into the first end 222 thereof. During assembly, a substantial axial portion of the second end 234 of the post 230 extends within the connector body 220 wherein an intermediate exterior portion feature 231 engages the post securing portion 223. The opposing first end 232 of the post 230 is defined by an open-ended cylindrical portion or socket 236, the socket being defined by a peripheral wall having a cylindrical receiving cavity terminating at a radial end edge 239 forming the "bottom" of the socket; i.e., that is the side opposite axially from the open end. The socket 236 includes a diameter that is larger than that of the remainder of the post 240, the socket further having a plurality of axial slots 238 spaced about the periphery of the peripheral wall.

According to this embodiment, a total of six (6) equally spaced slots 238 are provided at 60 degree intervals, each of the axial slots 238 extending in a direction parallel to the primary axis of the post 230 toward the second end from a distal end of the socket 236. According to this exemplary embodiment, the post 230 is made from brass, but other electrically conductive materials such as steel, can be utilized. Alternatively, for example, the second end 234 of the hollow post 230 can be made from a different material than the first end 232 wherein the second end of the post can be made, for example, from a non-conducting material.

Referring to FIG. 4, the coupling nut 250 is defined by a substantially cylindrical section having a pair of open ends; namely, a first end 252 and an oppositely disposed second end 254 interconnected by a center opening or bore 255. A portion of the center passageway 255 includes a series of internal threads 257 extending axially from an edge of the first end 252 over a span that is adequate to enable operable threading engagement with the external threads 274, FIG. 6, of a coaxial interface port 270, FIG. 6, as described in greater detail below. The coupling nut 250 is axially secured to the socket 236 of the post 230 by means of an annular recess 256 that is formed in the coupling nut, the recess being sized to receive a corresponding end flange 241 of the socket. The end flange 241 forms a snap ring that maintains the coupling nut 230 and prevents axial movement, but permits free rotation of the coupling nut about the exterior of the port retaining portion 236 and the longitudinal axis 211 of the connector 200. Alternatively, it should be noted that the coupling nut 250 could be provided with a flange for engaging a corresponding recess of the socket 236, provided rotation of the nut is permitted without axial movement.

Figure 6:
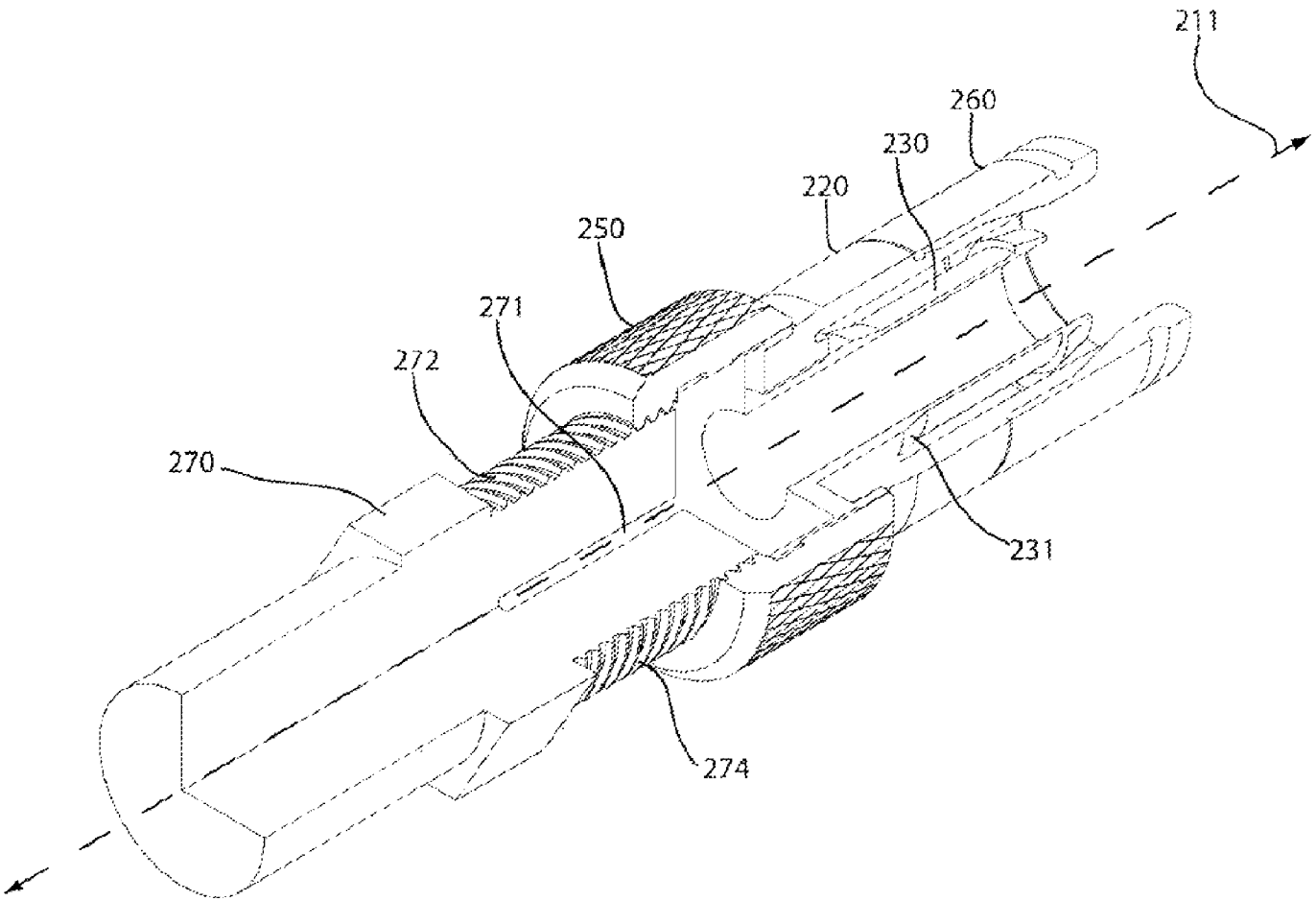
FIG. 6 is a perspective view, shown partially broken away, of the coaxial cable connector of FIGS. 3-5, as shown in a partially attached position relative to an external interface port.
Figure 7:
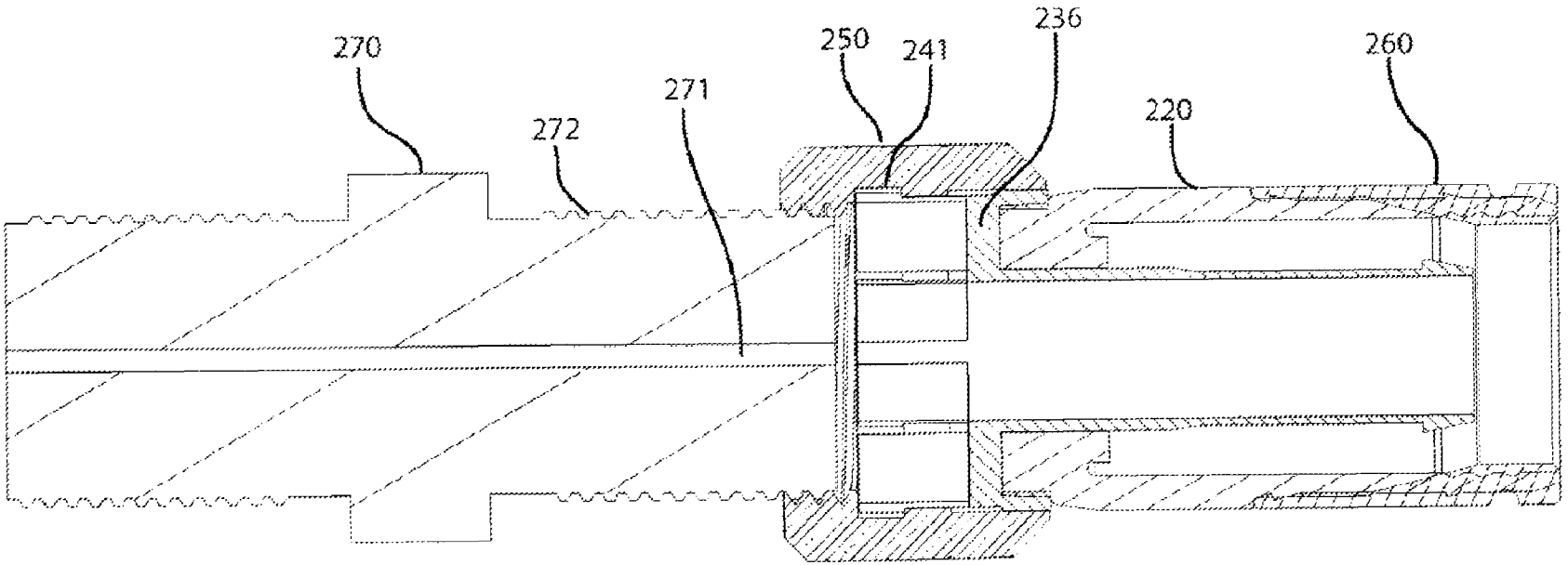
FIG. 7 is a sectioned side elevational view of the coaxial cable connector of FIG. 6, illustrating the partial securement of an external interface port.

When assembled, the interior threaded portion 257 of the coupling nut 250 extends outwardly toward the exterior interface port 270, while a distal axial section of the center conductor 18 of a prepared coaxial cable end 10 that has been secured within the connector 200 extends outwardly from the confines of the socket 236 as shown in FIGS. 6 and 7. The coupling nut 250 is secured to permit free rotation about the longitudinal axis 211 of the herein described coax connector 200, while enabling securement to an external appliance port 270. The coupling nut 250 according to this exemplary embodiment is made from brass, although other suitable materials, such as plastic, can be substituted.

Referring back briefly to FIG. 4, the compression member 260 is a ring or sleeve-like section defined by a hollow cylindrical section having a first end 262, an opposing second end 264 and a center passageway 263 extending therethrough. The compression member 260 is sized to fit over a portion of the exterior of the connector body 220. A ramped interior surface 265 is provided within the center passageway 263 that bridges two diametrical portions having different inner diameters. When moved axially with respect to the connector body 220 by means of a compression tool toward the first end (not shown) or otherwise, a first diametrical portion is sized to slide over the exterior surface of the connector body. As the compression member 260 advances axially, the ramped interior surface 265 is also caused to move axially over the exterior surface of the connector body 220, wherein the size mismatch between the inner diameter of the compression member and the outer diameter of the connector body causes the outer deformable portion 226 of the connector body 220 inwardly and radially compress to permit securement of a prepared coaxial cable end 10, FIG. 1, that is retained therein. An annular protrusion formed on the interior of the compression member 250 is disposed proximate the first end 262, the protrusion being configured to mate with an annular detent that is provided on the exterior of the connector body 220 similar to that described with regard to FIGS. 1 and 2. It should be noted, however, that alternative means for securing the compression member 260 relative to the compression body 220; for example, CMP connectors are known and can also be similarly utilized.

As shown in FIGS. 6 and 7, the coaxial interface port 270 is defined by a conductive receptacle 271 configured to receive the extending portion of the center conductor 18 of the prepared coaxial cable end 10 (partially shown) in a manner that provides electrical contact. In this embodiment, the interface port 271 includes a distal end 272 having an external surface with a threaded portion 274 sized in accordance with standards that are common within the communications industry.

The attachment of a coaxial cable end 10 to the herein described coaxial cable connector 200 is herein described. As described and shown in FIG. 1 and also shown in FIG. 3, the coaxial cable 10 includes a center conductor 18 as well as an overlaying grounding shield 14 and an outer protective layer or sleeve 12 separated by an intermediate dielectric layer 16, the latter being cored.

Referring to FIGS. 6-10, the coaxial cable end 10 is engaged by the first end 232 of the hollow post 230 such that the shielding layer 14 and the outer sleeve 12 are each disposed about the outer surface of the post 230 and between the outer surface of the post and the inner surface of the connector body 220. The cable is not shown fully for clarity in FIGS. 6, 7, and 10. As noted above, the compression member 260, when axially moved towards the coupling nut 250, causes the deformation of the axial external portion 226 of the connector body 220 radially inward, thereby retaining or securing the cable end 10 with the center conductor 18 having advanced through the center opening 235 of the post 230 and further extending into the center bore 255 of the coupling nut 250.

Figure 5:
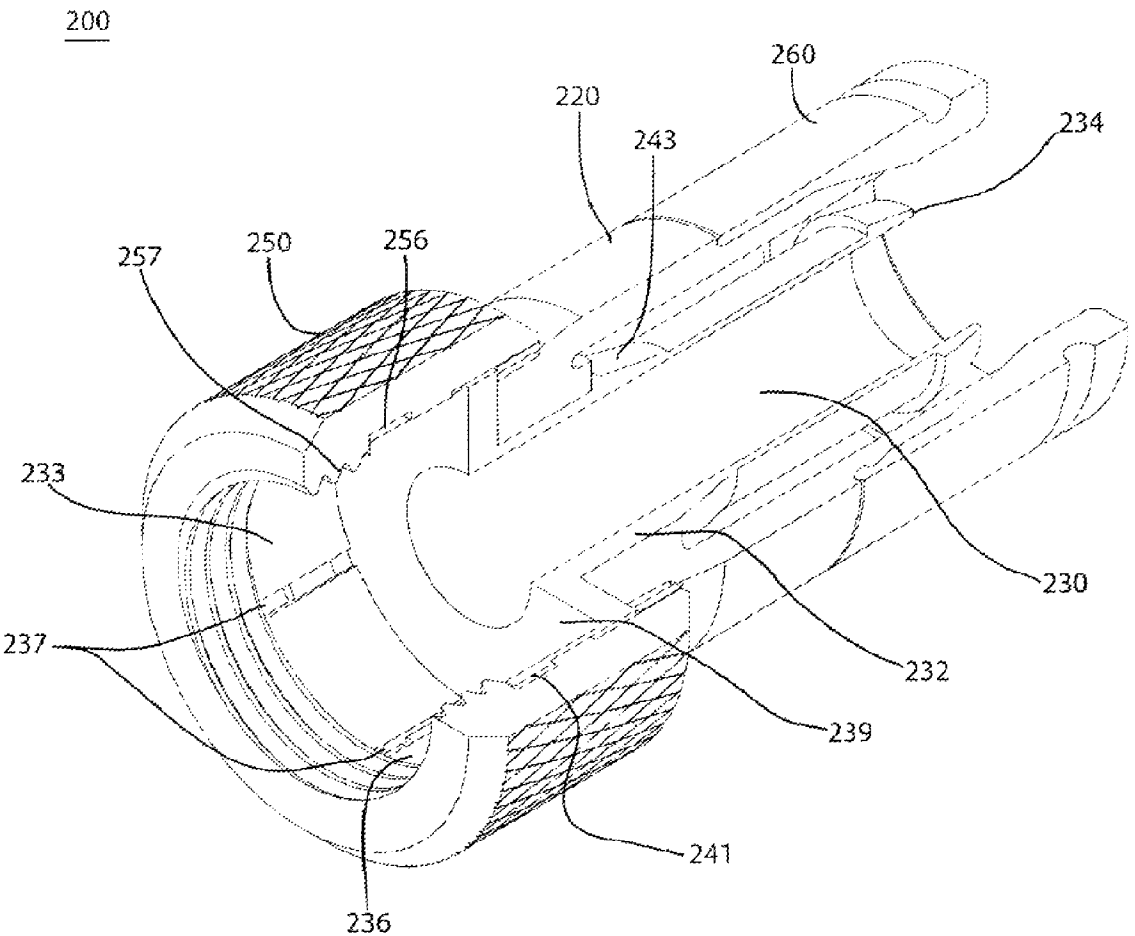
FIG. 5 is a partially sectioned perspective view of an assembled coaxial cable connector of FIGS. 3 and 4.

FIG. 5 illustrates an assembled version of the coaxial cable connector 100 without a coaxial cable end attached thereto for purposes of clarity. The coupling nut 250 is shown as cutaway in this figure in order to clearly illustrate the position of each of the components of the connector 200 prior to actual engagement with an external interface port. As shown herein and as previously noted, the coupling nut 250 is freely rotatable, but also axially secured to the post 230. As such, the coupling nut 250 according to this version is prevented from axial movement.

FIGS. 6-7 depict the initial engagement of a typical external interface port 270 to the herein described coaxial cable connector 200. First, the extending center conductor 18 of the secured coaxial cable end 10 is aligned with the conductive receptacle 271 of the external interface port 270. According to this embodiment, the interior threaded portion 257 of the coupling nut 250 is brought into engagement with the distal end 272 of the interface port 270 and more specifically the external threaded portion 274 thereof by means of clockwise rotation of the coupling nut 150. Mating engagement occurs between the external threaded surface 274 and the internal threaded portion 257 provided at the first end 252 of the coupling nut 250 as the coupling nut is rotated in a clockwise direction, according to this embodiment.

Figure 8:
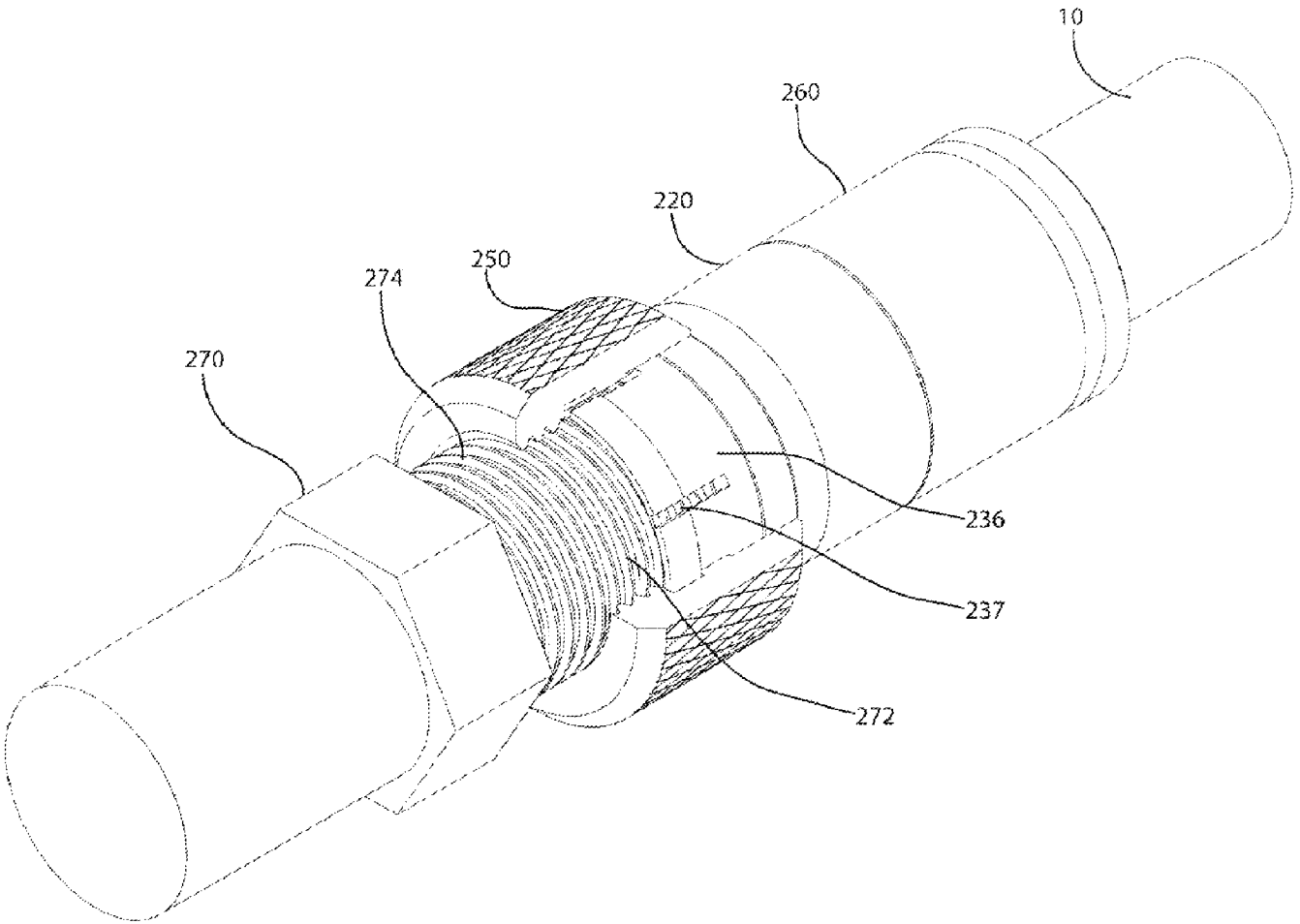
FIG. 8 is a perspective view of the coaxial cable connector of FIGS. 3-7, with the coupling nut shown as partially broken away, illustrating an external interface port, in a fully engaged position.
Figure 9:
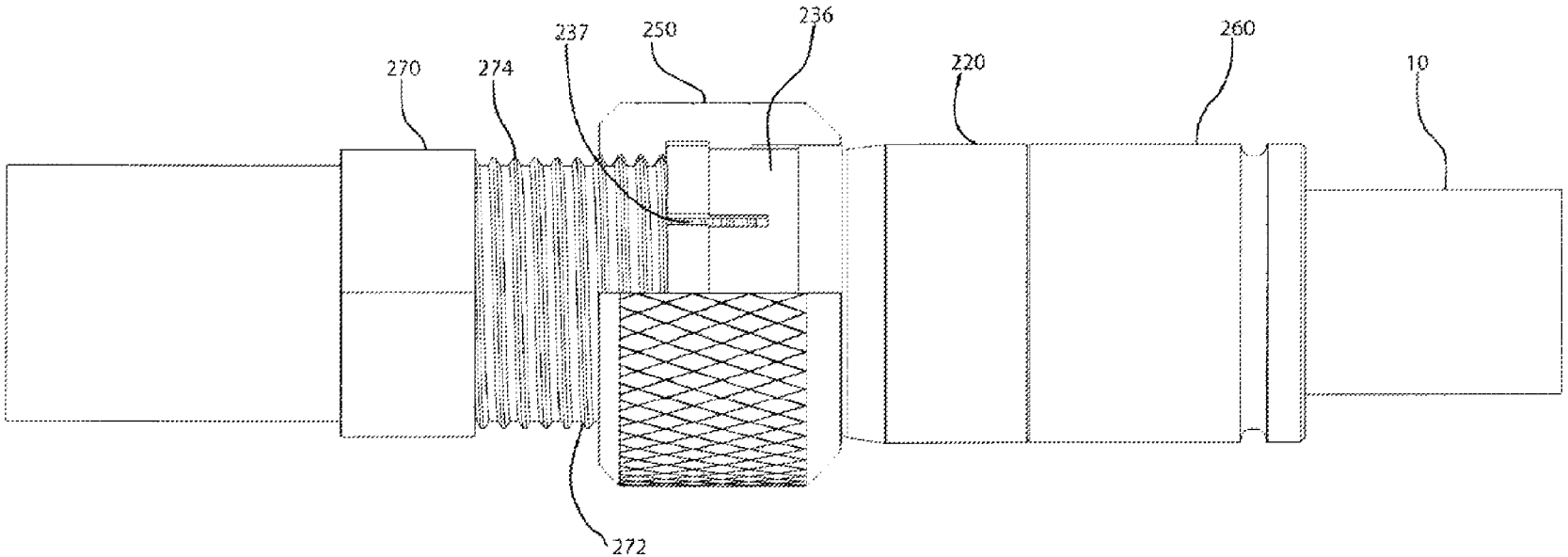
FIG. 9 is a side elevational view of the coaxial cable connector of FIG. 8, illustrating the fully secured external interface port.
Figure 10:
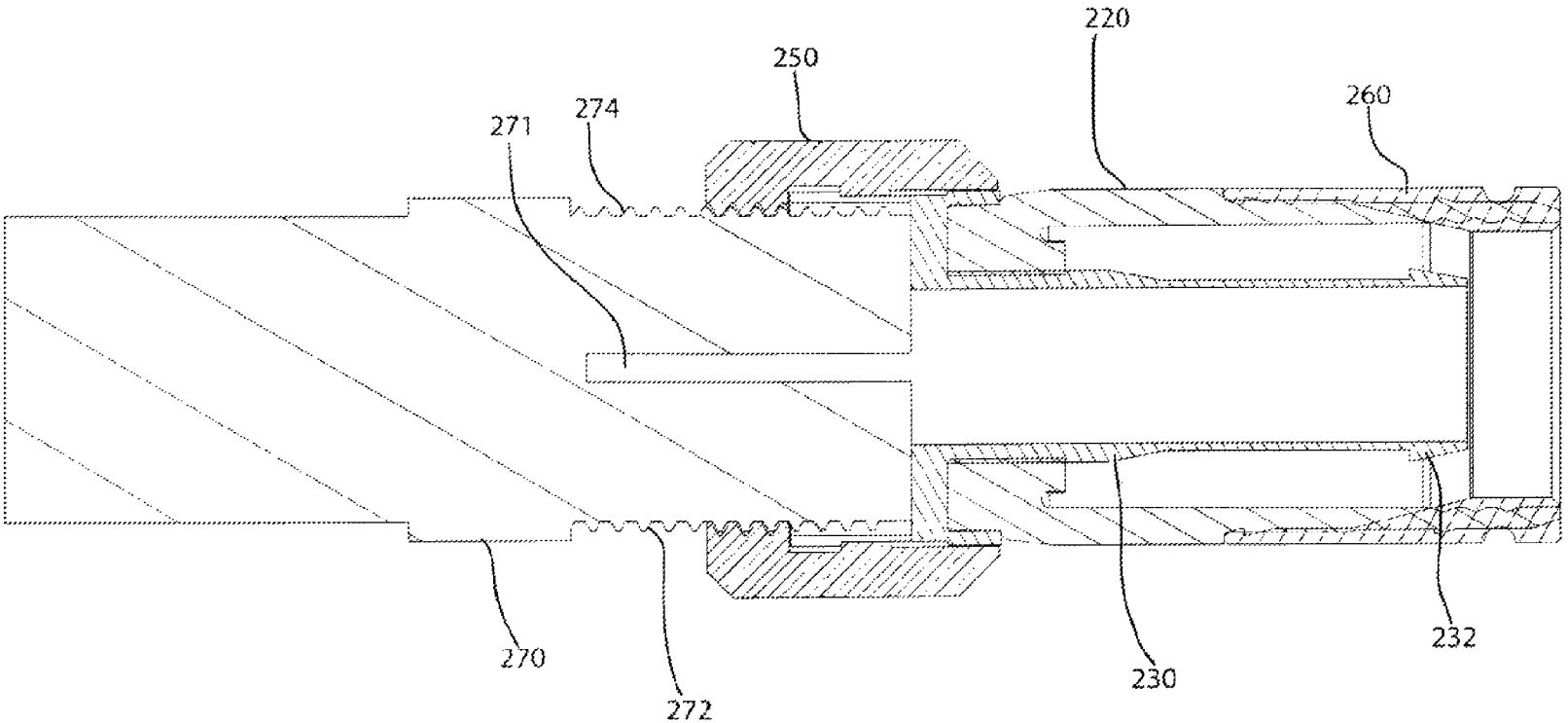
FIG. 10 is a sectioned side elevational view of the coaxial cable connector of FIGS. 8 and 9, illustrating the fully secured external interface port.

Referring to FIGS. 8-10, and as the coupling nut 250 is additionally cinched onto the threaded distal end 272 of the external interface port 270, the port is axially advanced toward the connector 200. More specifically, the distal end 272 of the interface port 270 is drawn into the cylindrical receiving cavity of the post socket 236 upon additional rotation of the coupling nut 240 while the internal threaded portion 257 of the coupling nut 250 axially advances over the threaded exterior surface 274. As the distal end 272 of the external port 270 is drawn into the confines of the socket 236, radial pressure is applied on each of the spring portions or fingers of the defined locking collet, thereby applying a locking or non-loosening force onto the engaged end of the external interface port 270. In addition, electrical continuity is achieved and maintained based on initial contact occurring between the internal surface 233 of the socket 236 and the external threaded surface 274 of the interface port 270. It is not required, however, that the external port 270 be fully tightened so as to compressively engage the radial end surface of the port with the radial flange of the post 230, as is required for example, in the above noted prior art coaxial cable connectors.

In addition, the amount of actual threaded area that is utilized by way of engagement between the interfacing external port 270 and the connector 200 is fractional, as compared with prior art coaxial cable connectors such as those illustrated, for example, in FIGS. 1 and 2. As the external interface port 270 is drawn into the locking collet that is defined by the socket 236 of the post 230, the amount of force required for effective securement to the connector 200 is therefore significantly reduced. In order to release the port 270 from the connector 200, the coupling nut 250 is rotated in a counterclockwise direction until the distal threaded end 272 of the port clears the internal threaded portion 257 of the coupling nut 250. As noted, electrical continuity is maintained even when the connector 200 is not fully tightened relative to the external interface port 270.

PARTS LIST FOR FIGS. 1-10

10 coaxial cable end
11 longitudinal axis, connector
12 outer conductor
14 grounding shield layer
16 dielectric layer, intermediate
18 center conductor
20 external port
23 set of threads
30 threaded nut
31 first end
32 second end
33 internal threads
34 internal lip
35 flange
40 post
41 first end
42 second end
43 shaft
44 flange
47 surface feature
50 connector body
51 first end
53 annular detent
55 compliant outer surface portion
57 post mounting portion
58 annular recess
59 annular serrations
60 compression member
61 first end
62 second end
65 center passageway or bore
66 ramped surface
67 first axial section
68 second axial section
69 exterior surface feature
80 body sealing member
100 coaxial cable connector
200 coaxial cable connector
211 longitudinal or primary axis, connector
220 connector body
222 first end
223 post securing portion
224 second end
225 central bore or passageway
226 axial proximal portion
230 hollow post
231 surface feature, post
232 first end
233 interior surface, retaining section
234 second end
235 center passageway
236 cylindrical portion, open-ended or socket
237 annular flange
238 axial slots
239 radial end edge
241 end flange, port retaining portion
250 coupling nut
252 open end
254 open end
255 central opening or bore
256 recess
257 internal threaded portion
260 compression member
262 end, open
263 center passageway
264 end, open
265 ramped interior surface
270 external appliance port
271 conductive receptacle
272 distal end
274 external threaded surface It will be readily apparent from the preceding description that other modifications and variations are possible within the intended technical ambits of the invention and as further defined by the following claims.

The invention claimed is:

1. A coaxial cable connector comprising:

a connector body;

a coupling nut freely rotatable about a primary axis of said connector, said coupling nut including an internal threaded portion configured for engaging a threaded surface of an external port; and a post having a pair of opposing ends, one of said ends being secured within said connector body and the opposing end having a open-ended port retaining portion, onto which said coupling nut is disposed in overlaying relation and into which the threaded surface of said external port is drawn by securing engagement of said coupling nut.

2. A connector as recited in claim 1, wherein said open-ended port retaining portion is made from an electrically conductive material such that electrical continuity is created when said interface port is initially received by said open-ended port retaining portion.

3. A connector as recited in claim 1, wherein said open-ended port retaining portion is a socket having substantially peripheral wall and a cylindrical receiving cavity, said peripheral wall having a plurality of slots extending axially from said open end, said slots defining a series of spring fingers further defining a locking collet.

4. A connector as recited in claim 1, wherein said connector is a compression-type coaxial cable connector.

5. A connector as recited in claim 1, wherein said open-ended port retaining portion is made from brass.

6. A connector as recited in claim 1, wherein the internal threaded portion of said coupling nut is distally adjacent to said open-ended port retaining portion.

7. A connector as recited in claim 1, wherein said post is secured to said connector body and said coupling nut is rotatably secured to the exterior of said open-ended port retaining section.

8. A connector as recited in claim 7, wherein one of said coupling nut and said open-ended port retaining portion includes an annular ring-like section sized for fitting within a groove formed in the other of said nut and retaining portion so as to prevent axial movement of said coupling nut relative to said post, but permitting free rotation of said coupling nut.

9. A connector as recited in claim 1, further including a compression member for securing a coaxial cable end to said connector body.

10. A connector as recited in claim 9, wherein said compression member is a compression sleeve.

11. A coaxial cable connector comprising:

a connector body having a first end, a second end and a center passageway therethrough;

a post having a first end and a second end, said first end having an open-ended port retaining portion, and said second end being disposed within the first end of said connector body for engaging a coaxial cable end; and a coupling nut disposed in overlaying relation to the first end of said post, said coupling nut being axially secured to the exterior of said open-ended post retaining portion but freely rotatable about a primary axis of said connector, said coupling nut including an internal threaded portion configured for engaging an exterior threaded surface of an external port, wherein said open-ended port retaining portion defines a locking collet into which said port is drawn by initial securing threaded engagement between said coupling nut and said external port.

12. A connector as recited in claim 11, wherein said internal threaded portion of said coupling nut is distally adjacent to said open-ended port retaining portion.

13. A connector as recited in claim 11, including a compression member for securing said coaxial cable end to said connector body.

14. A connector as recited in claim 13, wherein said compression member is a compression sleeve disposed in overlaying relation axially over said connector body.

15. A connector as recited in claim 11, wherein said open-ended port retaining section is a socket having a peripheral wall and a cylindrical receiving cavity, said socket including a plurality of axial slots extending from a distal open end of said peripheral wall, defining a plurality of spring fingers.

16. A connector as recited in claim 11, wherein said connector is a compression-type coaxial cable connector.

17. A connector as recited in claim 11, wherein said open-ended port retaining portion is made from an electrically conductive material such that electrical continuity is realized between an interface port and said connector when said port is not fully tightened.

18. A connector as recited in claim 11, wherein one of said coupling nut and said open-ended port retaining portion includes an annular ring-like section sized for fitting within a groove formed in the other of said coupling nut and said open-ended retaining portion to prevent axial movement of said coupling nut relative to said post, while permitting free rotation of said coupling nut.

19. A method of manufacturing a coaxial cable connector, said method comprising the steps of:

providing a connector body, said connector body having a hollow interior;

disposing one end of a post within said connector body;

axially securing said post, wherein an opposite end of said post includes an open-ended port retaining portion;

axially attaching a coupling nut in overlaying relation onto said open-ended port retaining portion, but permitting said coupling nut to be freely rotatable about said port retaining portion;

said coupling nut including a threaded portion distally adjacent said open-ended port retaining portion, said port retaining portion defining a locking collet for securing an interface port.

* * * * *